US009333792B2

(12) United States Patent
Hofmann

(10) Patent No.: US 9,333,792 B2
(45) Date of Patent: May 10, 2016

(54) PRINTING SYSTEM AND METHOD, CONTROL DEVICE, AND COMPUTER PROGRAM PRODUCT COMPRISING PRINT DATA INTEGRITY MONITORING

(75) Inventor: Holger Hofmann, Wörth (DE)

(73) Assignee: Oce Printing Systems GmbH, Poing (DE)

( * ) Notice: Subject to any disclaimer, the term of this patent is extended or adjusted under 35 U.S.C. 154(b) by 1627 days.

(21) Appl. No.: 10/544,972

(22) PCT Filed: Feb. 23, 2004

(86) PCT No.: PCT/EP2004/001767

§ 371 (c)(1),
(2), (4) Date: Feb. 22, 2006

(87) PCT Pub. No.: WO2004/073999

PCT Pub. Date: Sep. 2, 2004

(65) Prior Publication Data

US 2006/0156942 A1 Jul. 20, 2006

(30) Foreign Application Priority Data

Feb. 24, 2003 (DE) ..... 103 07 798

(51) Int. Cl.

| | |
|---|---|
| ***B41F 33/00*** | (2006.01) |
| ***B42C 19/00*** | (2006.01) |
| ***B41J 3/60*** | (2006.01) |
| ***B41J 29/393*** | (2006.01) |

(52) U.S. Cl.

CPC . *B42C 19/00* (2013.01); *B41J 3/60* (2013.01); *B41J 29/393* (2013.01); *B65H 2301/5111* (2013.01); *B65H 2511/512* (2013.01)

(58) Field of Classification Search

CPC ..... B65H 2511/512; B65H 2511/52; B65H 2511/519

USPC ..... 358/1.15, 3.28; 399/18, 79

See application file for complete search history.

(56) References Cited

U.S. PATENT DOCUMENTS

| | | | | |
|---|---|---|---|---|
| 3,458,688 | A | 7/1969 | Garry et al. | |
| 3,715,568 | A * | 2/1973 | Azure, Jr. | 235/437 |
| 4,429,217 | A | 1/1984 | Hill et al. | |
| 4,609,279 | A | 9/1986 | Hausmann et al. | |
| 4,774,524 | A | 9/1988 | Warbus et al. | |
| 4,959,832 | A * | 9/1990 | Bardell, Jr. | 714/739 |
| 5,265,008 | A * | 11/1993 | Benton et al. | 705/44 |
| 5,488,458 | A * | 1/1996 | Benedict et al. | 399/15 |
| 5,608,639 | A | 3/1997 | Twardowski et al. | |
| 5,613,669 | A | 3/1997 | Grueninger | |
| 5,796,694 | A * | 8/1998 | Shirane | 369/59.25 |
| 6,246,856 | B1 | 6/2001 | Kopp et al. | |

(Continued)

FOREIGN PATENT DOCUMENTS

| | | |
|---|---|---|
| DE | 100 50 438 | 1/2002 |
| EP | 1 227 053 | 2/2004 |
| JP | 1235658 | 9/1989 |

*Primary Examiner* — Peter K Huntsinger

(74) *Attorney, Agent, or Firm* — Schiff Hardin LLP

(57) ABSTRACT

In a method or system for monitoring of printed data in a printing system, a monitoring code for a respective page to be printed of a recording medium is generated. The monitoring code is printed on the respective page. The printed monitoring code is automatically read and evaluated such that monitoring numbers that are not contained in numerical succession in a monitoring list are used as the monitoring codes.

6 Claims, 9 Drawing Sheets

(56) References Cited

U.S. PATENT DOCUMENTS

| | | | | |
|---|---|---|---|---|
| 6,363,851 | B1 | 4/2002 | Gerhard et al. | |
| 6,501,929 | B1 | 12/2002 | Warbus et al. | |
| 7,198,260 | B2 * | 4/2007 | Huber et al. | 270/52.04 |
| 7,202,977 | B2 * | 4/2007 | Robinson et al. | 358/3.28 |
| 7,209,600 | B2 * | 4/2007 | Goldberg | 382/294 |
| 2003/0112479 | A1 | 6/2003 | Huber et al. | |

* cited by examiner

| Algorithm<br>Page nr. : Bit | Upper printing group<br>Page nr. : Bit : Result | Lower printing group<br>Page nr. : Bit : Result |
|---|---|---|
| 11 : 1 | 11 : 1 : OK | 11 : 1 : OK |
| 12 : 0 | 12 : 0 : OK | 12 : 0 : OK |
| 13 : 1 | 13 : 1 : OK | 13 : 1 : OK |
| 14 : 0 | 14 : 0 : OK | 14 : - : Marking missing |
| 15 : 1 | 15 : 0 : OK | 15 : 0 : OK |
| 16 : 1 | 16 : 1 : OK | 16 : 1 : OK |
| 17 : 0 | 17 : 0 : OK | 17 : 0 : OK |
| 18 : 1 | 18 : 1 : OK | 18 : 1 : OK |
| 19 : 0 | 19 : 0 : OK | 19 : 0 : OK |
| 20 : 0 | 20 : 0 : OK | 20 : 0 : OK |
| 21 : 1 | 21 : 1 : OK | 21 : 1 : OK |
| 22 : 1 | 22 : - : Marking missing | 22 : 1 : OK |
| 23 : 1 | 23 : 1 : OK | 23 : 1 : OK |
| 24 : 1 | 24 : 1 : OK | 24 : 1 : OK |
| 25 : 1 | 25 : 1 : OK | 25 : 1 : OK |
| 26 : 0 | 26 : 0 : OK | 26 : 0 : OK |

Fig. 8

| Algorithm<br>Page nr. : Bit | Upper printing group<br>Page nr. : Bit : Result | Lower printing group<br>Page nr. : Bit : Result |
|---|---|---|
| 11 : 1 | 11 : 1 : OK | 11 : 1 : OK |
| 12 : 0 | 12 : 0 : OK | 12 : 0 : OK |
| 13 : 1 | 13 : 1 : OK | 13 : 1 : OK |
| 14 : 0 | 14 : 0 : OK | 14 : - : Marking missing |
| 15 : 1 | 15 : 1 : OK | 15 : 1 : OK |
| 16 : 1 | 16 : 1 : OK | 16 : 1 : OK |
| 17 : 0 | 17 : 0 : OK | 17 : 0 : OK |
| 18 : 1 | 18 : 1 : OK | 18 : - : Marking missing |
| 19 : 0 | 19 : 0 : OK | 19 : 0 : OK |
| 20 : 0 | 20 : 0 : OK | 20 : 0 : OK |
| 21 : 1 | 21 : 1 : OK | 21 : 1 : OK |
| 22 : 1 | 22 : - : Marking missing | 22 : 1 : OK |
| 23 : 1 | 23 : 1 : OK | 23 : 1 : OK |
| 24 : 1 | 24 : 1 : OK | |
| 25 : 1 | 25 : 1 : OK | 25 : 1 : OK |
| 26 : 0 | 26 : 0 : OK | 26 : 0 : OK |

Fig. 9

| Algorithm<br>Page nr. : Bit | Upper printing group<br>Page nr. : Bit : Result | Lower printing group<br>Page nr. : Bit : Result |
|---|---|---|
| 13 : 1 | 13 : 1 : OK | 13 : 1 : OK |
| 14 : 0 | 14 : 0 : OK | 14 : 0 : OK |
| 15 : 1 | 3424 : 0 : Bit error 1 | 15 : 1 : OK |
| 16 : 1 | 3425 : 1 : OK ? | 16 : 1 : OK |
| 17 : 0 | 3426 : 0 : OK ? | 17 : 0 : OK |
| 18 : 1 | 3427 : 1 : OK ? | 18 : 1 : OK |
| 19 : 0 | 3428 : 0 : OK ? | 19 : 0 : OK |
| 20 : 0 | 3429 : 0 : OK ? | 20 : 0 : OK |
| 21 : 1 | 1068 : 1 : OK ? | 21 : 1 : OK |
| 22 : 1 | 2074 : 1 : OK ? | 22 : 1 : OK |
| 23 : 1 | 2075 : 1 : OK ? | 23 : 1 : OK |
| 24 : 1 | 2076 : 1 : OK ? | 24 : 1 : OK |
| 25 : 1 | 2408 : 1 : OK ? | 25 : 1 : OK |
| 26 : 0 | 2409 : 0 : OK ? | 26 : 0 : OK |
| 27 : 1 | 27 : 1 : OK | 27 : 1 : OK |
| 28 : 1 | 28 : 1 : OK | 28 : 1 : OK |
| 29 : 1 | 29 : 1 : OK | 29 : 1 : OK |

Fig. 10

| Algorithm<br>Page nr. : Bit | Upper printing group<br>Page nr. : Bit : Result | Lower printing group<br>Page nr. : Bit : Result |
|---|---|---|
| 17 : 0 | 17 : 0 | 17 : 0 : OK |
| 18 : 1 | 18 : 1 | 18 : 1 : OK |
| 19 : 0 | 19 : 0 | 19 : 0 : OK |
| 20 : 0 | 2469 : 1 Bit error 1 | 20 : 0 : OK |
| 21 : 1 | 2470 : 1 : OK ? | 21 : 1 : OK |
| 22 : 1 | 2471 : 1 : OK? | 22 : 1 : OK |
| 23 : 1 | 1111 : 1 : OK ? | 23 : 1 : OK |
| 24 : 1 | 1120 : 1 : OK ? | 24 : 1 : OK |
| 25 : 1 | 3973 : 0 Bit error 2 | 25 : 1 : OK |
| 26 : 0 | 3974 : 1 Bit error 3 | 26 : 0 : OK |
| 27 : 1 | 3975 : 1 Abort | 27 : 1 : OK |
| 28 : 1 | 3976 : 1 Abort | 28 : 1 : OK |
| 29 : 1 | 1993 : 0 Bit error 4 | 29 : 1 : OK |
| 30 : 0 | 31 : 1 : Bit error 5 | 30 : 0 : OK |
| 31 : 1 | 32 : 1 : Abort | 31 : 0 : OK |
| 32 : 1 | 33 : 1 : Abort | 32 : 0 : OK |
| 33 : 1 | 34 : 1 : Abort | 33 : 0 : OK |

Fig. 11

PRINTING SYSTEM AND METHOD, CONTROL DEVICE, AND COMPUTER PROGRAM PRODUCT COMPRISING PRINT DATA INTEGRITY MONITORING

BACKGROUND

The preferred embodiment concerns a printing system and in particular a method, a control device and a computer program product for monitoring of printed data in a printing system. The preferred embodiment furthermore in particular concerns a method for monitoring of printed data in an electrographic high-capacity printing system.

In electrographic high-capacity printing systems with a print capacity of more than 40 pages per minute, both margin-perforated, ribbon-shaped paper and paper without margin perforation are used as recording media.

In high-capacity printing systems it is necessary that the print data and the printer itself are synchronized per page. For this, a method is known in which at least two print images are printed on each printed sheet, whereby each print image comprises a barcode. This barcode contains consecutive numbers. They can be read by a specific workstation such as, for example, a further printer or printing group or a post-processing station. If deviations of the barcodes result within a sheet, this is assessed as an error.

Instead of the barcode, in principle the page numbers of the printed document can also be used, whereby the printing of a further monitoring mark in the form of the barcode can be omitted.

However, it is not always possible to use the page numbers, in particular when a large print job is comprised of a plurality of individual shorter documents with fewer pages respectively or when the documents comprise no page numbers. The automatic scanning of page numbers is additionally significantly more complicated than that of barcodes.

What is disadvantageous in the previously-known method is that the barcodes used are very large and significantly affect the print image of a printed page.

A method for monitoring of a high-capacity production process for production of printed products is known from U.S. Pat. No. 5,613,669. In this manufacturing process, the sheets to be printed are conveyed in a predetermined direction. An image of the sheet or a section of the printed sheet is recorded by means of a camera. Individual sections of the manufacturing process are synchronized with the method, and the position of the sheets in the manufacturing process is calibrated. Furthermore, this method comprises a control device with which an alarm can be triggered in the event that, for example, the sheets are not correctly merged. This control function evaluates the image acquired by the camera, whereby a predetermined section of the print image or a code (such as, for example, a dash code) is read and evaluated.

A device for automatic identification of the line position emerges from U.S. Pat. No. 3,458,688. In addition to the possibility to identify lines, this device also exhibits a device for identification of different document types. Each document type is identified by means of a binary code that can be printed as a dash code on the document.

U.S. Pat. No. 4,429,217 describes a device and a method for verification of credit cards, insertion of credit cards in corresponding card coverings and stacks of the card coverings in a suitable manner for insertion of the cards into letter envelopes. The cards are typically identified using specific information in the form of alphabetical, numerical or optical characters (for example 1-barcode or I-barcode) or using the information contained on magnetic stripes.

A method for production of folded, bound printed products is described in U.S. Pat. No. 6,363,851. The initial product can be provided with individually-printed markings so that each bound end product exhibits at least one such marking. For example, the page number or a sequence of additional pages can be added by means of this marking. The marking can also represent the end of a specific sequence with which it can then be monitored whether all necessary partial products are present. The marking is preferably printed in a region that is cut off at the end of the production process.

DE 10050 438 C1 discloses a method for synchronization of a plurality of paper-feeding channels of an enveloping system. Every sheet supplied by means of such a channel contains corresponding data or information for designation of the affiliation of the sheet with a specific group, data for designation of the sheet sequence within a group and additional data that specify whether the sheet is a last or consecutive sheet of a group. These data can, for example, be applied on the sheets with the aid of a barcode, a 2 D code, or another suitable coding. The group sequence number can, for example, be comprised of a six-digit numeral series and the sheet sequence number can be comprised of a two-digit numeral series. The designation of a still-running group or of the group examination device can occur in the form of one bit. Given an error, only one group is affected, which group can be sorted out and, for example, supplemented by hand as needed.

Furthermore, in what are known as tandem printing systems it is normally necessary to position with page-precision the print images of both printing devices of the tandem printing system. A tandem printing system is described in U.S. Pat. No. 4,609,279. In U.S. Pat. No. 4,774,524, for activation of such a printing system it is provided to connect the main control devices of both printers via a host computer on a data control level on the one hand and via a second connection on a device control level on the other hand. From U.S. Pat. No. 6,501,929, it is known to synchronize the printed page series in a tandem printing system via an electronic storage. From U.S. Pat. No. 5,488,458, a duplex printing system is known in which a monitoring code is generated and printed for a page to be printed and the printed monitoring code is evaluated. A printing device with two printing groups for simultaneous printing of the front and backsides of a web-shaped recording medium is known from U.S. Pat. No. 6,246,856. The publications cited above are herewith incorporated by reference into the present specification.

SUMMARY

It is an object to achieve a method for monitoring of printed data in a printing system that is suitable for use of smaller codes in comparison with conventional barcodes and with which the per-page synchronization of a large print job can nevertheless be safely monitored. It is also an object to achieve a printing system for implementation of the method.

In a method or system for monitoring of printed data in a printing system, a monitoring code for a respective page to be printed of a recording medium is generated. The monitoring code is printed on the respective page. The printed monitoring code is automatically read and evaluated such that monitoring numbers that are not contained in numerical succession in a monitoring list are used as the monitoring codes.

BRIEF DESCRIPTION OF THE DRAWINGS

FIG. 8 shows a control panel display with correctable marking read errors;

FIG. 9 illustrates a control panel display with a non-correctable marking read error;

FIG. 10 shows a further control panel display with a correctable marking read error; and FIG. 11 illustrates a further control panel display with a plurality of non-correctable marking read errors.

DESCRIPTION OF THE PREFERRED EMBODIMENT

Figure 1:
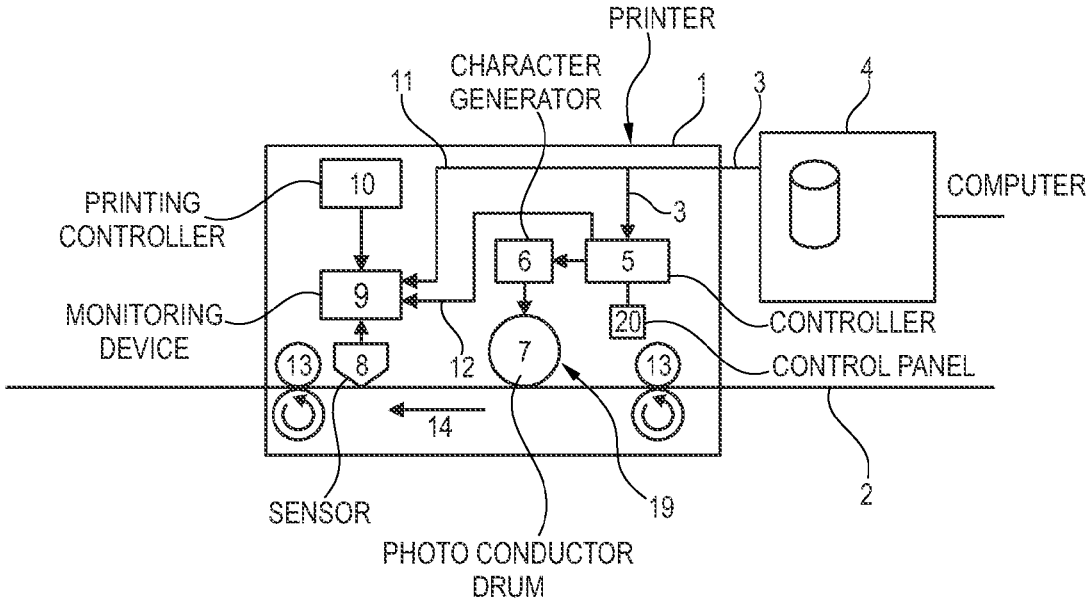
FIG. 1 shows a schematically simplified printing system for execution of the method of the preferred embodiment.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

According to a first aspect of the preferred embodiment, a method for monitoring of printed data in a printing system comprises the following steps:

- generation of a monitoring code for a respective page to be printed,
- printing of the monitoring code on the respective corresponding page of a recording medium to be printed,
- automatic reading and evaluation of the printed monitoring code.

The preferred embodiment is characterized according to this aspect in that monitoring numbers that are not contained in numerical succession in a monitoring list are used as monitoring codes. Upon evaluation of the read monitoring numbers, these can in particular be compared with the series of the monitoring numbers of the monitoring list, whereby a deviation is assessed as an error.

In the event that two or more monitoring numbers are printed on one sheet, it is also possible to execute the evaluation via comparison of the monitoring numbers of the sheet, whereby a deviation is assessed as an error.

According to a further advantageous exemplary embodiment of the invention, upon evaluation of the read monitoring numbers their sequence is compared with that of the monitoring list.

Since the sequence of the monitoring numbers in the monitoring list deviates from a numerically increasing or numerically decreasing sequence, a very small quantity of numbers can be used as the quantity of the monitoring numbers (such as, for example, a number quantity comprised of a maximum of 64 numbers, and in particular a number quantity comprised of a maximum of 16 numbers, up to a number quantity comprised of only eight, four or even only two numbers), and nevertheless it is possible to monitor a large number of pages. This is possible in that, in contrast to conventional methods in which each individual monitoring number possesses a high information capacity, the information is transferred from the monitoring numbers into the monitoring list in which this information is stored by the sequence of the individual monitoring numbers. The information contained in the monitoring list is all the larger the greater the entropy (in the numerical sense) of the monitoring list. In conventional methods, a decimal number range of, for example, 0 to 99 is printed as a binary number in the form of a dash or barcode as a monitoring number or monitoring marking. These binary numbers comprise seven digits and therefore form a correspondingly long bar or dash code.

The preferred embodiment allows the use of one-, two- or three-digit numbers. In the extreme case, a one-digit binary number is used as a monitoring number, meaning that each monitoring number is either "0" or "1".

The number quantity of the monitoring numbers can thus even be limited to two numbers with the method of the preferred embodiment. With the preferred embodiment, a number quantity can be used that does not comprise more than 32 numbers, in particular not more than 16 numbers or not more than 8 numbers The preferred embodiment also differs from known methods in that the monitoring list comprises more monitoring numbers than the monitoring numbers comprised by the number quantity. Individual monitoring numbers are thus repeatedly contained in the monitoring list.

The monitoring list can either be provided as a stored data list or by means of a method (algorithm) for generation of a successive sequence of monitoring numbers. These methods are realized with typical pseudo-random number generators.

The period with which the monitoring numbers repeat in the monitoring list is preferably greater than the typical printing volume that is executed on the printing system or greater than the maximum page number that can result in a printing problem without safely being noticed in another manner. If the typical print jobs comprise only a few to a hundred pages, a repetition period of 100 monitoring numbers is sufficient. If the print jobs are significantly more extensive, it is thus appropriate to provide correspondingly larger repetition periods. However, if some thousand pages are not printed in a large print job, this does not otherwise occur without the monitoring system is needed for this. The repetition periods must therefore in principle not comprise more than a thousand or a few thousand monitoring numbers. In the framework of the preferred embodiments, it is naturally also possible to use longer repetition periods. The repetition period can in particular be significantly increased when the monitoring lists are generated by means of pseudo-random number generators.

According to a second aspect of the preferred embodiment that can also be viewed in combination or also independent of the first aspect, a method that comprises the following steps is provided for monitoring of printed data in a printing system:

- generation of a monitoring code for a respective print image to be printed,
- printing of at least two print images with one respective monitoring code on a sheet to be printed,
- automatic reading and evaluation of the printed monitoring code.

This method is characterized in that monitoring numbers that are not contained in the monitoring list in numerically ascending or descending succession are used as monitoring codes, and upon evaluation of the read monitoring numbers the monitoring numbers of a respective sheet are compared with one another and, given a deviation, this is assessed as an error.

According to a preferred embodiment method of the invention, a complete sequence of n read monitoring numbers is determined by means of the preferred embodiment monitoring method after establishment of an error, and using this sequence it is established in which page number of the print job the error has occurred. The determination of the page number can occur by means of a decoding table in which are stored all sequences of n-monitoring numbers and the corresponding page numbers. However, it is also possible to determine the page number so that the monitoring numbers are generated in succession starting with a specific monitoring number until the complete sequence of read monitoring numbers had been generated, whereby the number of the generated monitoring numbers is a measure for the page number.

The term "page" also comprises the terms "print image" and "printed page". A sheet in the sense of the present preferred embodiment can, for example, also be discussed when a sheet-shaped recording medium (Engl. cut sheet recording carrier) is used; however a web section can also be understood by a sheet when a continuous or web-shaped recording medium (Engl. fanfold, continuous or web-shaped recording carrier) is used that is initially printed in the web-shaped state and is cut into a single sheet in a processing event downstream in terms of the printing. In the latter procedure, an association with the last generated sheet can already occur during the printing when the corresponding post-processing events are clearly defined.

According to a third aspect of the preferred embodiment that can be viewed in combination with the previously-cited aspects, the preferred embodiment concerns a method and a device for monitoring of the precise page association of print data on the print product, what is known as the data integrity. This is in particular of importance in printing devices or printing systems that comprise a plurality of printing groups and in which at least two printing groups print on the same recording medium and in particular on a region of the recording medium that is associated with an output sheet. In the course of the second printing event, the printed bit-marks are detected, the read result is compared with the originally-associated code, and the printing process is controlled with this.

For generation of the output sheet, in particular a web-shaped recording medium can be tailored to the sheet shape along the region borders in a later processing step.

According to a fourth aspect of the preferred embodiment that can be viewed in combination with or also independent of the previously-cited aspects of the invention, a method for monitoring of the per-range data integrity in the transfer of print data from a data source to a data receiver is provided in which, upon transmission, the print data are numbered consecutively per range corresponding to an N-digit binary number, whereby N is a natural number. Using the consecutive number, a one-digit monitoring code is read from a monitoring list and transferred with the print data of the range. A specification sequence of N one-digit monitoring codes is contained only once within the monitoring list. Upon receipt of the print data, the associated one-digit monitoring code is respectively read per range and a decision about the data integrity is automatically made using a comparison of the read sequence of one-digit monitoring codes with the code sequences available in the monitoring list.

According to this aspect, the data integrity in the per-range transfer or printing of print data can be checked with a simple, minimal, one-digit binary monitoring code. The binary monitoring code is on the one hand non-interfering in the transfer of the data because it has such a small information content. On the other hand, in particular upon printout it enables a minimal print image in the form of a simple dash that can also in particular be printed on the region border, for example page border of a document. The printed dash code can thereby additionally still be used for data integrity checking as a control marking for the processes downstream from the printing event, such as cutting, folding or perforating of the recording medium.

According to an advantageous exemplary embodiment of the fourth aspect of the preferred embodiment, upon receipt of the print data using N successive one-digit monitoring codes an N-digit read binary number associated with a range is formed and, with this, the consecutive numbering is reconstructed and checked; this can occur in that its position in the monitoring list is determined and the number associated with this position is compared with the consecutive number of the range generated upon transmission.

In a further advantageous embodiment, the N-digit read binary number is associated with a range whose read monitoring code is contained in the N-digit read binary number and is in particular associated with the range whose read monitoring code stands at the first or last position of the N-digit binary number. Using the comparison result it can then automatically be decided per range whether data have been lost in the data transfer.

When the numbering instructions in the transmission and in the reception of the print data are the same, a decision about the number of the ranges at which data have been lost can be made automatically using the comparison result.

For the fourth aspect, a computer or a controller (in particular integrated into a printer) can be used as a data source. A controller, a printing group that respectively prints the one-digit binary monitoring code as a bit marking on a region of the recording medium and/or in particular also a recording medium as a medium of the printed information including the monitoring code can be used as a data receiver. Furthermore, the printed bit markings can be read with a sensor and the read result can be compared with the monitoring code associated upon transmission, and the printing process can be controlled with this. With the preferred embodiment it is therewith possible to effect a continuous integrity monitoring for the print data from the generation of the data in a computer (in particular host computer) up to the finished printed document. It is thereby in particular advantageous that related print data of a region (for example in form fields of forms or on the front side and back side of the document) that are generated on the document by various individual printing processes with one or more printing groups can be checked with regard to their data integrity or correct relation.

It is also advantageous to print the data of a range on a common region of the recording medium. When the recording medium has been cut into output sheets, it is advantageous when the printed monitoring code belonging to a region of an output sheet lies on a marginal edge of the output sheet generated upon cutting.

According to the fourth aspect, the monitoring list can also be provided as a stored data list or by means of a method (algorithm) for generation of a successive sequence of monitoring numbers, meaning that both the transmitting system (data source) and the receiving system (data receiver) can alternatively operate with the monitoring list as a stored list (for example look-up table (LUT)) or calculate the monitoring numbers of the monitoring list online with a computer processor.

Furthermore, the preferred embodiment method or device can in particular be combined with the methods or devices that are known from the previously-cited publications U.S. Pat. No. 4,609,279; U.S. Pat. No. 4,774,524 and U.S. Pat. No. 6,501,929.

Devices, printing apparatuses, controllers or computer software are also inventively provided that can automatically effect a process of the preferred embodiment.

A printing system for execution of the method of the preferred embodiment is shown schematically simplified in FIG. 1. This printing system comprises a printer 1 (that is preferably a high-capacity printer) for printing of a paper web 2. The printer 1 is connected via a data line 3 with a computer 4 from which the printer 1 receives a print data stream via the data line 3. The computer 4 is either a server that merely buffers or forwards the print data stream or a host at which the print job and the corresponding print data stream is generated. The IPDS (Intelligent Printer Data Stream)-print data stream typical for high-capacity printers is used as a print data stream. It is naturally also possible to use print data streams in other formats such as, for example, PCL (Print Command Language), PS (Post Script) or AFP (Advanced Function Presentation).

In the printer 1, the data line 3 leads to a controller 5 in which the print data contained in the print data stream are prepared for a subsequently-arranged character generator. The character generator 6 generates control signals for activation of a printing group 19 with a photoconductor drum 7 with which the print data are printed on the paper web 2. The character generator 6 and the photoconductor drum 7 form a printing group 19. The controller 5 is furthermore connected with a device controller (not shown) that controls the various aggregates of the printing apparatus, for example the paper transport, the electrophotography unit, the fixing station etc. Furthermore, the controller 5 is connected with a control panel 20 on which system information can be displaced and via which settings of the printer 1 can be effected. It can comprise known means such as a screen (in particular touchscreen), keyboard and/or mouse, etc. For high-capacity printers, the paper web 2 is typically a continuous paper web. However, by this time printers with very high capacity that print on single sheets are also known in which the application of the method of the preferred embodiment is also appropriate.

Monitoring numbers are generated in the controller 5 and inserted into the print data stream. This is explained in detail below.

A sensor 8 for scanning of the monitoring numbers printed on the paper web 2 is provided adjacent to the paper web 2, downstream from the photoconductor drum 7. If the monitoring numbers are printed in the form of a dash code or barcode, the sensor is thus a simple photosensor that detects the brightness differences on the paper web. The sensor 8 is connected with a monitoring device 9 that is in turn coupled to a central print controller 10.

The paper web 2 is driven in the transport direction 14 by a transport device 13.

The data stream supplied via data line 3 contains additional information about the print job such as, for example, sheet or page numbers that are also supplied to a monitoring device 9 via a further data line 11. As an alternative to this, this additional information can initially be supplied only to the controller 5 that then passes it on to the monitoring device 9 via a further data line 12. The data line 11 can then be omitted. In this case it is also possible that the controller 5 itself generates the additional information about the print job and delivers it to the monitoring device 9 in the event that no such information is available to the computer 4.

Two control signals (A) and (B) (FIG. 2) serve for control of the printing process within the printer. The control signal (A) is a central start/stop signal with which the beginning and the end of the printing event or printing process are marked. The control signal is typically generated by the character generator 6 as soon as this receives the information from the controller 5 that sufficient prepared print data are available for the printing process. The control signal (B) is a clock signal that provides a predetermined clock that enables a temporal synchronization of all devices participating in the printing process and is always available to these. Using the start/stop signal (A) and the clock signal (B), the individual devices of the printer 1 can determine when the individual pages or predetermined locations on these pages come past them. At the beginning of a printing process there is typically a delay (C1) until the leading edge of the first page passes a predetermined point in the printer 1 and the passage time (C2) of the further pages or sheets is typically constant.

Both the printing by means of the photoconductor drum 7 and the scanning of the monitoring numbers by the sensor 8 are temporally controlled with the aid of these control signals.

Figure 5:
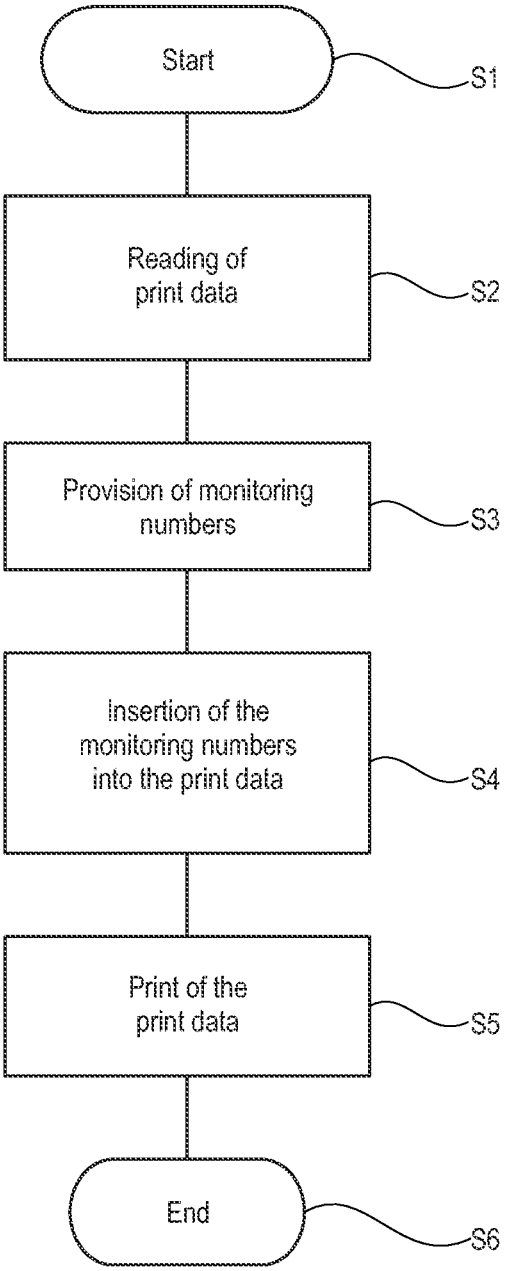
FIG. 5 illustrates schematically simplified in a flow diagram a part of the method of the preferred embodiment with which monitoring numbers are generated and printed.

The part of the method that is executed in the controller 5 is subsequently explained in detail using the flow diagram from FIG. 5.

This method begins with step S1. In step S2 the controller 5 reads the print data coming from the computer 4 via the data line 3.

A device for generation of monitoring numbers, with which the monitoring numbers are provided (step S3), is provided in the controller 5.

This device can be a list of stored monitoring numbers. However, this device can also be designed as a method. Such methods are, for example, pseudo-random number generators.

In the event that the same device as in the controller 5 is provided in the monitoring device 9 for generation of monitoring numbers, the controller 5 and the monitoring device 9 must synchronize with one another so that both devices respectively provide the same sequence of monitoring numbers. Such a synchronization can occur by means of a synchronization command from the controller 5 via the data line 12 to the monitoring device 9. Thus synchronization occurs, for example, after an interruption of the printing event due to an error state and after correction of the error state. An error state in this sense is also an error established in the printing event by the monitoring unit 9.

The sequence of monitoring numbers should possess an optimally small redundancy, meaning that sequences with a specific number of monitoring numbers optimally occur only once in the entire list of monitoring numbers. In other words, this means that the entropy should be optimally large in the sense of the numerics of the monitoring number sequence.

The number sequence 1, 0, 1, 0, 1, 0 . . . possesses a very high redundancy and a very low entropy since this sequence repeats with the period two. It is appropriate to provide significantly longer repetition periods. For printing systems that are provided for small print jobs, a repetition period of 100 can already be sufficient. However, larger repetition periods of at least 1000, 10000 or more are advantageously to be used.

The monitoring numbers so generated are inserted into the print data (step S4). A mark that reproduces the monitoring number is hereby reproduced at a predetermined location in each page to be printed. Such a mark is also designated as a monitoring mark.

The method of the preferred embodiment allows for the monitoring numbers a small number quantity with, for example, sixteen, eight, four or only two numbers that can be represented with correspondingly few digits, for example as one-digit or two-digit monitoring numbers. Such monitoring numbers can be printed with a marking that is smaller (in terms of area) than monitoring numbers made up of an extensive number quantity.

Figure 4:
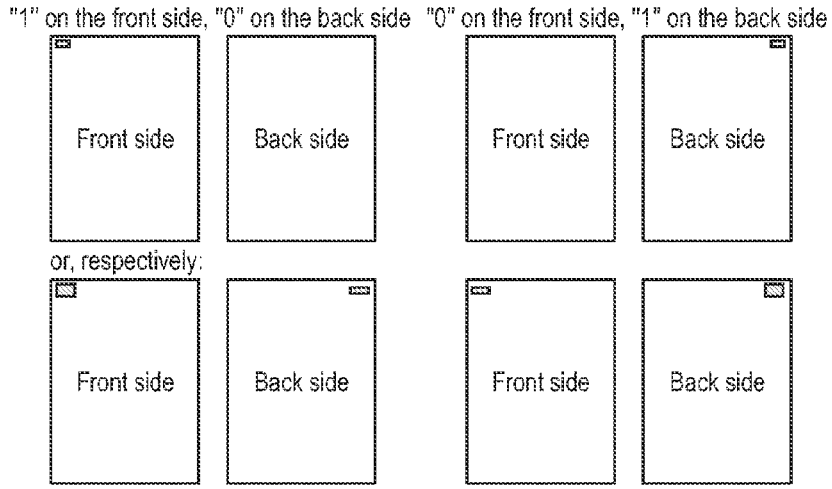
FIG. 4 illustrates possible representations of one-digit binary monitoring numbers on the printed sheet.

In principle it is possible to provide the monitoring numbers in an arbitrary number system such as, for example, a hexadecimal, decimal or binary number system. However, monitoring numbers are preferably in a binary system. The monitoring numbers are preferably represented by means of dash codes or bar codes since these can be simply, automatically detected. Either a thin or a thick dash or a present or not-present dash is thus provided for each digit. This is shown in FIG. 4, whereby here the front side and backside of a sheet is respectively shown on which the corresponding monitoring numbers are printed in the form of a dash code. The dash code is in this example structured in binary, i.e. only a zero or a one is coded. The zero can thereby be coded by no dash (shown in the upper pages of FIG. 4) or by a relatively thin dash (shown in the lower pages of FIG. 4). The one is then coded by a dash (upper pages) or by a relatively thick dash (lower pages). Given the use of the variants with various dash thicknesses it is advantageous that an individual dash can be printed in a predetermined printing region on each page to be printed, which dash can be sensed by the devices (such as, for example, cutting devices) downstream from the printing event and be used as a trigger marking for specific actions such as, for example, the cutting of the recording medium at page transitions. The dash can in particular be printed along the page border at page transitions of a web-shaped recording medium, whereby it can in practice completely disappear after a cutting event and therewith can later no longer interfere. The dash code can also comprise a plurality of dashes for the preferred embodiment and/or represent monitoring numbers of more than one bit of information content.

After the insertion of the monitoring numbers into the print data, these are printed on the paper web 2 by means of the printing group (step S5). The method for generation and printing of the monitoring numbers is then ended (step S6).

Figure 6:
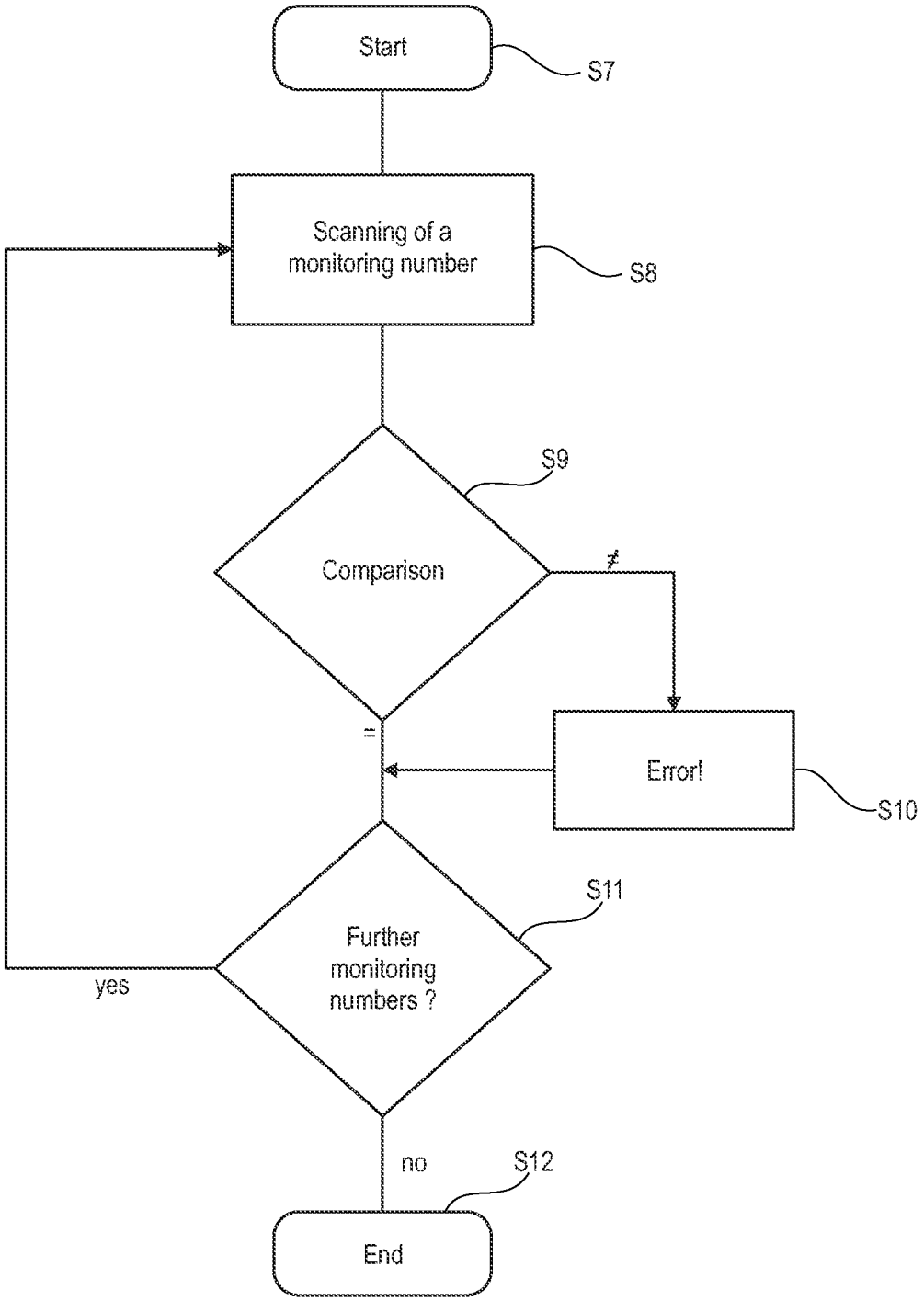
FIG. 6 shows schematically simplified in a flow diagram a part of the method of the preferred embodiment with which the printed monitoring numbers are monitored and evaluated.

A further part of the method of the preferred embodiment that is subsequently explained in detail using the flow diagram shown in FIG. 6 is executed on the monitoring device 9.

Figure 2:
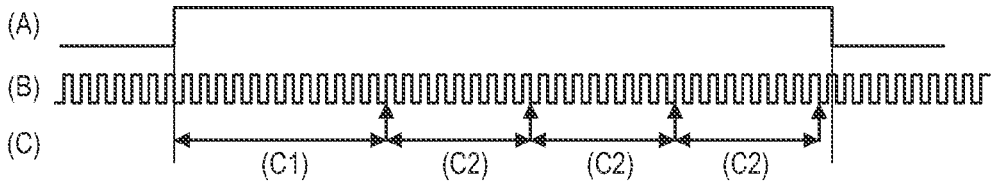
FIG. 2 illustrates control signals for a printing process.

This method begins with the step S7, The monitoring markings or monitoring numbers printed on the paper web 2 are scanned by means of the sensor 8 in the step S8. The scanning event is temporally controlled by the start/stop signal (A) and the clock signal (B) (FIG. 2). Exactly-predetermined regions on the respective printed pages can thus be scanned.

The sensor 8 transduces the scanned light signals into digital signals, namely into the monitoring numbers, and forwards these to the monitoring device 9. In the monitoring device the read monitoring number is compared with a corresponding monitoring number of the monitoring list (step S9).

The monitoring list can in turn be stored in the form of a pre-stored data list in the monitoring device 9 or can be generated by means of a predetermined method such as, for example, a pseudo-random number generator. Independent of how the sequence of monitoring numbers is provided in the monitoring device 9, this sequence of monitoring numbers must be synchronized with the pages to be monitored. This occurs in the present exemplary embodiment in that the first monitoring number in the monitoring list is associated with the first page defined by the start/stop signal (A) and the clock signal (B), and the further monitoring numbers of the list, in the order existing in the monitoring list, are associated with the pages following the first page in this order (with which they are also inserted into the pages of the print data by the controller 5).

If, in this comparison (step S9), it is established that the read monitoring number should not be the same as the corresponding monitoring number of the monitoring list, this means that the sensor has scanned a monitoring number that does not correspond to the page that should be present at the corresponding point in the sequence of pages of the printing process. Such a deviation is thus assessed as an error. A corresponding error message is relayed to the print controller 10 (step 10).

The method process then switches over to the step S11, in which it is checked whether a further monitoring number is to be scanned. If this is the case, the method process switches again to the step S8; otherwise the method is ended with the step S12.

If the comparison in step S9 results in the read monitoring number being equal to the corresponding monitoring number in the monitoring list, the method switches directly from step S9 to the step S11.

This method can be modified to the effect that it is not only determined whether the correct monitoring number is read by the sensor 8, but rather it is also determined whether the monitoring number passes by the sensor at exactly the predetermined point in time at which it should pass the sensor, and in the event that a temporal deviation exists, this can, for example, be measured in units of the clock signal. The deviation of the monitoring number from the ideal position on the paper web is measured via the determination of the temporal deviation. The register precision of the printing on the paper web can thus be determined.

Since according to the preferred embodiment, the information contained in the order of the monitoring numbers present in the monitoring list is used, the information contained in one monitoring number can be very small. It is therefore even possible to use only a one-digit binary number as a monitoring number. With the preferred embodiment, the information contained in the monitoring numbers is thus correlated with the information contained in the order of the monitoring number.

A linear congruent generator with which the random numbers are generated with the following formula can be used as a pseudo-random number generator:

$$x_n=(a\cdot x_{n-1}+b)\bmod m, \tag{1}$$

whereby $x_n$ is the pseudo-random number calculated in the calculation step n. The preceding pseudo-random number $x_{n-1}$ is simultaneously the "internal state" of the pseudo-random number generator. The pseudo-random number generator is initialized in that $x_{n-1}$ is set to a defined value. The operator "mod" designates the whole-number remainder of a division. The coefficients a, b and m are suitably selected. For example, the following coefficients can be used:

a=1103515245 b=12345 c=2147483648=$2^{31}$

When additional information about the print job should be incorporated in the pseudo-random number generator, this can be realized with the following algorithm:

$$x_n=(a\cdot(x_{n-1}+s_n)+b)\bmod m, \tag{2}$$

whereby $s_n$ is the additional information, for example a page or sheet number, that is supplied by the server for each page or sheet.

A monitoring number with only a few bits of information content can be calculated from a pseudo-random number with the following formula:

$$y_n = \left((x_n mod c) div \frac{c}{2^i}\right) \sim k, \tag{3}$$

whereby $y_n$ is the random number calculated in the calculation step n from the pseudo-random number $x_n$. The coefficient c can be a power of two for reasons of a simple calculation. The coefficient i is the information content of the code in bits. i=1 means one bit of information content. The operator "div" designates the whole-number division, thus the division with truncation of the decimal places.

The coefficient k serves for inversion (variation) of the code values. The operator "~" designates the per-bit exclusive-or linking which serves for inversion of the calculated code. For example, it can be appropriate in a double-sided printing to use a sequence of monitoring numbers for the front side and the corresponding sequence of inverted monitoring numbers for the back side.

Example:

$c=32768=2^{15}$ i=1 k=0 front side (no inversion)

k=1 back side (inversion)

The method of the preferred embodiment can be very advantageously applied in a tandem printing system. Such a tandem printing system comprises two printers 1*a*, 1*b* (FIG. 3) with a respective controller 5*a*, 5*b*, a line generator 6*a* 6*b*, printing groups that respectively comprise a photoconductor drum 7*a* or 7*b*, a monitoring device 9*a*, 9*b* and a printing controller 10*a*, 10*b*. Both printers 1*a*, 1*b* print on a common paper web 2, whereby the paper web 2 is reversed by means of a reversal device 15 in the region between the two printers 1*a*, 1*b*. One page surface of the paper web is thus respectively printed by each printer 1*a*, 1*b* so that the paper web is printed on both page surfaces.

Both printers 1*a* and 1*b* receive the print data stream from a computer 4 via respective data lines 3*a* and 3*b*. The data stream contains additional information about the print job (such as, for example, sheet or page numbers) that is also supplied to the monitoring devices 9*a* or 9*b* via further data lines 11*a* or 11*b*. This additional information can alternatively first be supplied only to the controllers 5*a* or 5*b* that then pass this to the monitoring devices 9*a* or 9*b* via further data lines 12*a* or 12*b*. The data lines 11*a* and 11*b* can then be omitted. In this case it is also possible that the controllers 5*a* or 5*b* themselves generate the additional information about the print job and supply it to the monitoring devices 9*a* or 9*b* in the event that no such information is available to the computer 4.

Two control signals (A) and (B) (FIG. 2) respectively serve within each printer for control of the printing process. The control signal (A) is a central start/stop signal with which the beginning and the end of a printing even or printing process are marked. The control signal is typically generated by a character generator 6*a* or 6*b* as soon as this receives from the controller 5*a* or 5*b* the information that the printing process can begin. This is the case in the printer 1*a* when prepared print data sufficient for the printing process are available in both printers 1*a* and 1*b*. This is the case in the printer 1 when sufficient print data is available there and additionally a sufficiently-long paper web (supplied by printer 1*a*) is present for printing. The control signal (B) is a clock signal that provides a predetermined clock that enables a temporal synchronization of all devices participating in the printing process and is always available to these.

Both printers 1*a*, 1*b* can respectively be operated individually and in particular also in common via the control panels 20*a*, 20*b* as what is known as a single point of operation.

The printer 1*a* is arranged before the reversal device 15 in the transport direction (arrow 14) and, similar to the printer 1 from FIG. 1, is designed with a sensor 8*a*. The second printer 1*b* that is arranged after the reversal device 15 in the transport direction comprises two sensors 8*b*, 8*v*, whereby the sensor 8*a* is arranged adjacent to one side of the paper web 2 and the sensor 8*c* is arranged at the same height adjacent to the other side of the paper web 2 such that both sides of the paper web are scanned by the sensors 8*b*, 8*c*.

The monitoring of the printing process occurs in the printer 1*a* exactly as in the printing system shown explained above in FIG. 1. In contrast to this, in the printer 1*b* both sides of the paper web are monitored. Monitoring numbers that have, for example, been generated by means of the same monitoring list are printed on both sides, whereby the monitoring numbers are not inverted on one side and the monitoring numbers are inverted on the other side. Two monitoring numbers, one for the front side and another for the back side, are thus read out in the monitoring. The inverted monitoring number is initially inverted again so that both read monitoring numbers can be compared with one another and with the corresponding monitoring number of the monitoring list. If one of these three monitoring numbers deviates, an error exists and is corresponding output.

The monitoring list can in turn be provided by a predetermined list of monitoring numbers that is stored in both controllers 5*a*, 5*b*. However, it can also, for example, be generated in the controller 5*a* by means of a suitable method and the monitoring numbers can be forwarded to the controller 5*b* of the printer 1*b* via the data line 3. However, the monitoring numbers are preferably generated in both controllers 5*a*, 5*b* by means of a suitable method such as, for example, a pseudo-random number generator. For this the random number generator is started with the same start parameters at a corresponding point in time.

For example, the beginning of a large print job or (in the event that a printing event had to be interrupted due to an error state) the continuation of this printing event after correction of the error state can be established as a corresponding point in time. Given a regular interruption of a printing event when, for example, toner is refilled or a paper stack must be removed, it is not necessary to restart the random number generators.

The monitoring numbers are further set and processed in the controllers 5*a* and 5*b* via the per-page processing of the print data stream. The monitoring numbers are further set in the monitoring devices via the per-page scanning of the monitoring codes, which is enabled synchronized with the printing event via the control signals (A) and (B).

Figure 3:
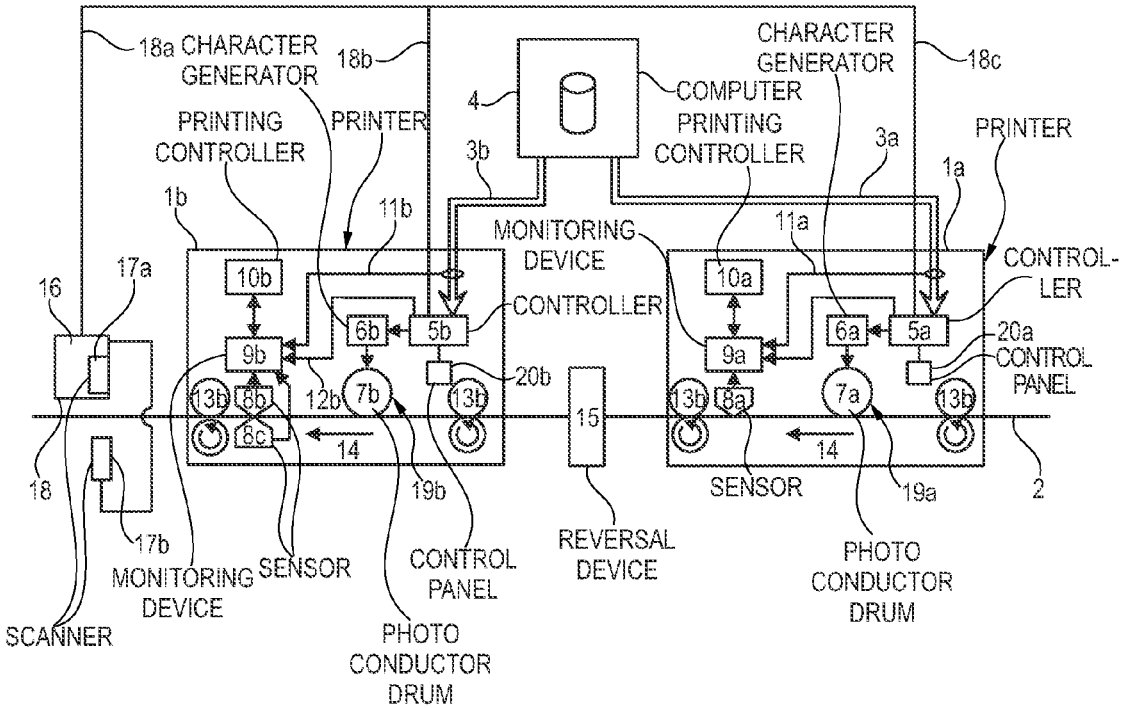
FIG. 3 shows schematically a tandem printing system.

The printed monitoring numbers printed as a dash code can furthermore be used for control of further processes that are executed on the web-shaped recording medium or on the paper web, for example cutting, folding, punching, stapling or gluing processes. In the example of FIG. 3, a cutting device 16 is arranged after the second printing device 1*b* in the paper travel direction, which cutting device 16 comprises two sensors 17*a*, 17*b* at both sides of the paper web 2 in order to be able to scan both reversed recording media printed on both sides and un-reversed recording media printed on one side. One of the sensors 17*a*, 17*b* thereby detects the printed dash code (corresponding to the monitoring number) on the paper web 2. The point in time at which the blade 18 of the cutting device cuts the paper web 2 into two parts is then controlled with the scan signal. When the dash code is comprised of only one dash, the blade 18 can be controlled so that it divides the paper web 2 exactly along the dash. It can thereby be achieved that the printed dash lies on the outermost edge of the cut paper or that the dash is cut or punched out and in practice no longer interferes in the paper sheet thereby generated.

The above exemplary embodiment shows how the printing process in two printers of a tandem printing system can be synchronized with one another by means of the method of the preferred embodiment. However, in the framework of the preferred embodiment it is not only possible to synchronize printing processes, but rather it is also possible to synchronize a printing process with a post-processing process. Such post-processing processes are, for example, the cutting of paper webs, the punching or binding of the printed sheets. A plurality of different post-processing devices are known. A monitoring device with a corresponding sensor is provided in the post-processing device for synchronization with the printing system as it is used in the printers explained above. The monitoring list is respectively provided in the monitoring device and the monitoring numbers are read from the pages to be monitored in order to be compared with the corresponding monitoring numbers of the monitoring list.

The monitoring numbers of the preferred embodiment can also be generated with the linear feedback shift register, which is also designated as an LFSR method ("Linear Feedback Shift Register").

With the LFSR method a bit sequence can be generated that possesses the special property that every arbitrary sequence of n successive bits only ever occurs precisely once within the overall sequence of N bits. The overall length N of the bit sequence can thereby be a maximum of $2^n$.

In the LFSR method, a sequence of values $a_k$ (k=1 N) is generated according to the following formula. The numbers $a_k$ and s respectively comprise n bits:

$$A_k = a_{k-1} \cdot 2 + \text{parity}(a_{k-1} \hat{} s), \tag{4}$$

whereby $a_k$ is a k-th random number, $a_{k-1}$ is the preceding random number, s is a key, ^ is a per-bit AND-linkage and parity is a function with which the number of the bits of the respective value are counted and the bit count 0 results for an even number of bits and 1 results for an uneven number of bits.

The bits of $a_{k-1}$ are shifted to the left with the multiplication of $a_{k-1}$ with 2, whereby the most significant bit is truncated.

For example, the decimal numbers 45462 or 46278 are suitable keys for n=16. They provide a number sequence of the maximum possible length without repetition, i.e. a repetition period of $N=2^{16}-1=65535$. These keys are called "maximal keys".

There are special hardware solutions in the form of integrated circuits for execution of this method.

One bit is respectively "extracted" from each calculation number $a_{k+1}$, for example the bit at the binary position 0. These extracted bits form the bit sequence:

$$B_k = a_k \hat{} 1. \tag{5}$$

The key value (key) s and an initial value a that respectively have a length of n bits are to be established as parameters of the LFSR algorithm. Given a suitable selection of the key s, the LFSR method generates a bit sequence with a maximum length of $N=2^n-1$ bits; and the bit sequence repeats afterwards.

In the LFSR method explained above, the state $a_k=0$ leads to a "blockade" since the subsequent state, independent of the key s, is likewise 0:

when: $a_k=0$ it follows that: $a_{k+1}=0$

The state $a_k=0$ is, however, never reached when a maximum key as well as an initial value $a_1 \neq 0$ are used.

Via the expansion of the LFSR method, the "missing" state $a_k=0$ can now be incorporated into the number sequence. The length of the number sequence thereby expands to $N=2^n$.

It is namely shown that, given use of a maximum key, it always applies that:

when: $a_k=2^{(n-1)}$ it follows that: $a_{k+1}=1$

This transition from $2^{(n-1)}$ to 1 occurs given all maximum keys because the most significant bit in all maximum keys is set at the binary position n−1.

Given this transition, the state "0" can be inserted since it occurs in equal measure for all maximum keys.

The number sequence is expanded by one state: . . . → $2^{(n-1)} \rightarrow 0 \rightarrow 1 \rightarrow$ . . . .

Figure 7:
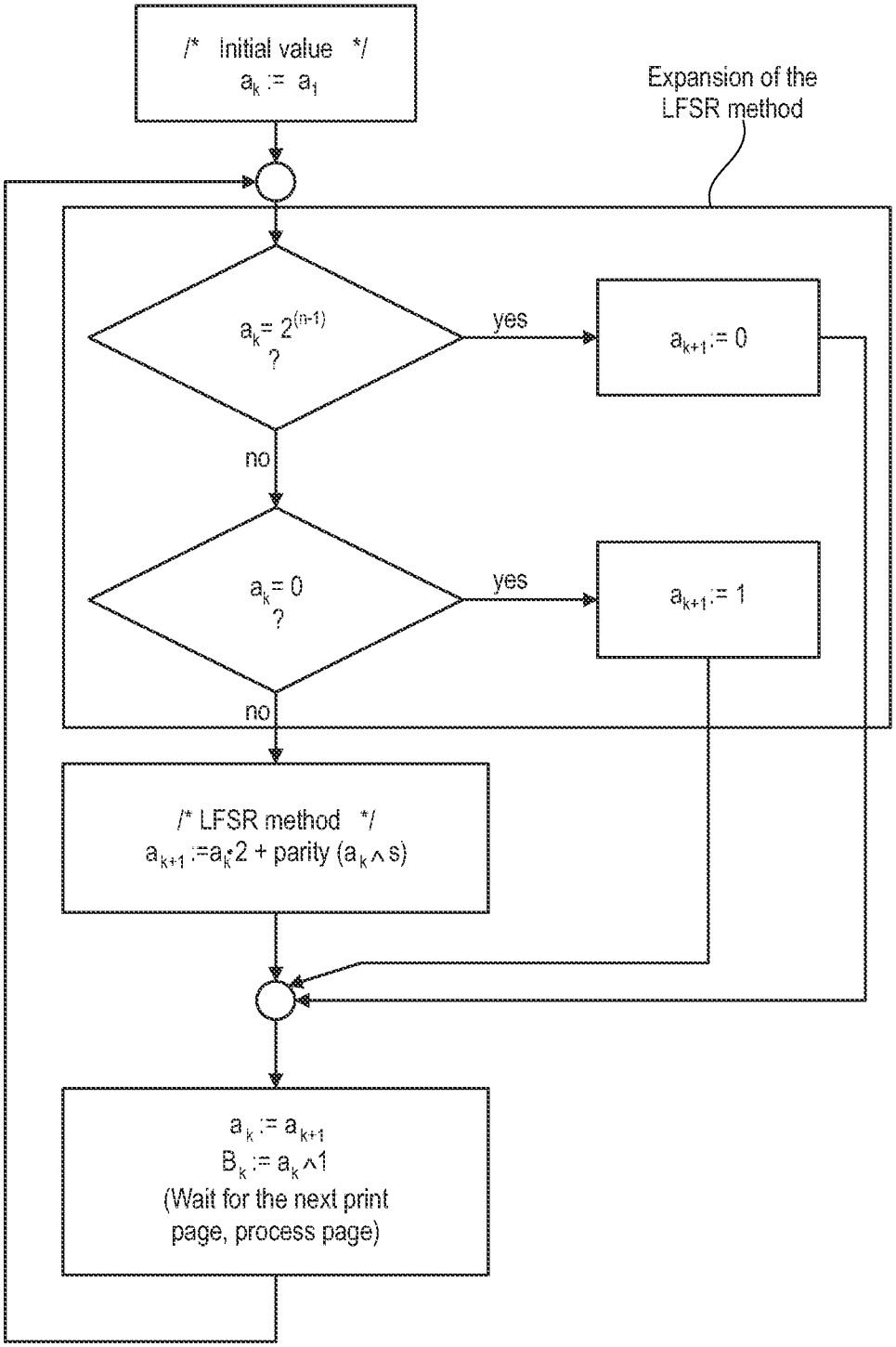
FIG. 7 shows a modified LFSR method in a flow diagram.

In order to prevent a "blockade" in the state 0, the LFSR method is expanded as it is shown in the flow diagram from FIG. 7.

The property of the bit sequence, that every arbitrary sequence of n successive bits always occurs only once within the entire sequence of N bits, is now used for the determination of the page numbers. A sequence of n successive bits is understood as a coded page number. The coded page number can then be converted into the normal, uncoded page number via a decoding method.

The monitoring number, which forms not the complete page number but rather only a portion of a page number, is printed on each page. This means that a page number is distributed on m successive pages with one respective monitoring number. Each monitoring number is comprised of t bits, whereby t is a factor of n. A sequence of m successive monitoring numbers can then be combined again into a complete page number.

It is thereby true that $$n = t \cdot m \tag{6}$$

The highest achievable page number Z is $$Z = \frac{N}{ggt(N, t)} \tag{7}$$

[ggt: largest common denominator]

whereby it can be that $$N = 2^n - 1 \tag{8a}$$

or $$N = 2^n. \tag{8b}$$

In the simplest case, t=1, m=n and Z=N. This means that a page number comprised of n bits is distributed on n pages and the monitoring number of each page is still comprised of only one bit.

The special case t>1 should be examined more closely here. Each monitoring number is comprised of $$m = \frac{n}{t} \text{bits}. \tag{1}$$

An optimally large range is now sought for the page numbers 1 through Z. According to the formula (7), this is achieved when the denominator ggt(N, t) is optimally small. In the best case, the denominator is equal to 1 and Z=N therewith applies.

For $N=2^n-1$ (8a), this is the case when t is even (or equal to 1).

For N=2" (8b), this is the case when t is odd.

Given t>1, while the page numbers cycle from 1 to Z, the bit sequence (comprised of N bits) of the LFSR method then cycles multiple times, and in fact a maximum of t times.

Examples:

$$\text{a) } t = 2;\ n = 16;\ m = 8;\ N = 2^n - 1 = 65535$$

$$Z = \frac{65535}{GGT(65535;\ 2)} = 65535$$

The monitoring numbers of eight successive pages yield a complete page number. Each monitoring number is comprised of two bits. The page numbers run from 1 to 65535. The bit sequence of N=65535 bits is thereby run through twice. In the second passage, the bit positions are shifted by one relative to the first passage; the second passage is thereby differentiable from the first.

$$\text{b) } t = 3;\ n = 15;\ m = 5;\ N = 2^n = 32768$$

$$Z = \frac{32768}{GGT(32768;\ 3)} = 32768$$

The monitoring numbers of five successive pages yield a complete page number. Each monitoring number is comprised of three bits. The page numbers run from 1 to 32768. The bit sequence of N=32768 is thereby run through three times.

During the printing event, t steps of the LFSR method are respectively passed through for each print page or printed sheet. t bits are thereby supplied for one respective monitoring number. This monitoring number is printed on the paper according to the method described above and detected by means of a monitoring device.

The page number of a page is determined in that the monitoring number is read from this page along with the monitoring numbers of the m−1 preceding pages. The total m of the monitoring numbers are then combined into a coded page number (according to an established order).

The complete number of preceding pages or monitoring numbers is not yet present at the beginning of a print job, i.e. for the pages 1 through m−1. Here the monitoring numbers of the not-present pages are replaced by defined replacement or start values that correspond to the end sequence of the bit sequence generated by the LFSR method. Given a suitable selection of the initial value a, the missing monitoring numbers can always be set to 0.

The method can alternatively also be realized such that the monitoring numbers of the "sought" page and the subsequent m−1 pages are combined. However, then the determination of the page number for the last m−1 pages of a print job is problematic or not possible.

In the subsequent example, t=1, n=m=16, $Z=N=2^n=65536$, a=0, s=46278

| Page (Page range): | Bit sequence, Monitoring numbers: | coded page number (hex.): | uncod. page number: |
|---|---|---|---|
| Page 1: | 0 1 1 1 0 0 0 1 1 1 1 1 0 0 0 1 0 1 1 0 0 0 0 0 ... | $0001_h$ | 1 |
| Page (1..) 2: | 1 1 1 1 1 0 0 0 1 1 1 1 1 0 0 0 1 0 1 1 0 0 0 0 0 ... | $0002_h$ | 2 |
| Page (1..) 3: | 1 0 1 1 1 0 0 0 1 1 1 1 1 0 0 0 1 0 1 1 0 0 0 0 0 ... | $0005_h$ | 3 |
| Page (1..) 15: | 1 0 1 1 1 0 0 0 1 1 1 1 1 0 0 0 1 0 1 1 0 0 0 0 0 ... | $5C7C_h$ | 15 |
| Page (1..) 16: | 1 0 1 1 1 0 0 0 1 1 1 1 1 0 0 0 1 0 1 1 0 0 0 0 0 ... | $B8F8_h$ | 16 |
| Page (2..) 17: | 1 0 1 1 1 0 0 0 1 1 1 1 1 0 0 0 1 0 1 1 0 0 0 0 0 ... | $71F1_h$ | 17 |
| Page (3..) 18: | 1 0 1 1 1 0 0 0 1 1 1 1 1 0 0 0 1 0 1 1 0 0 0 0 0 ... | $E3E2_h$ | 18 |
| ... | | | |
| Page (65520..) 65535: | 1 0 0 0 0 0 0 0 0 0 0 0 0 0 0 0 0 0 1 0 1 1 1 0 0 0 ... | $8000_h$ | 65535 |
| Page (65521..) 65536: | 1 0 0 0 0 0 0 0 0 0 0 0 0 0 0 0 0 0 1 0 1 1 1 0 0 0 ... | $0000_h$ | 65536 |
| Page (65522..) 65537: | 1 0 0 0 0 0 0 0 0 0 0 0 0 0 0 0 0 0 1 0 1 1 1 0 0 0 ... | $0001_h$ | 1 |

In this example, a monitoring number that is respectively comprised of one bit is printed on each page. The first read monitoring number is understood as the most significant digit; the last read monitoring number is understood as the least significant digit. The monitoring numbers missing in the pages 1 through 15 are assumed to be "0". At the page 65536, the end sequence of the series shows that these monitoring numbers actually assume the value 0.

After the 65536th page, an "overflow" occurs; and the LFSR method begins again from the start. The subsequent page numbering begins again virtually with 1.

In order to obtain the regular, uncoded page number, a decoding method is used that supplies the uncoded page number z from the coded page number c. Various methods thereby lend themselves to this, whereby a tradeoff is to be made between storage requirement and calculation time.

The variant with the shortest calculation time (however the largest storage requirement) uses a decoding table in which the associated uncoded page number is stored for each coded page number. Given N=65536, the table requires 128 Kbytes:

$$z = \text{DecodeTable}[c] \tag{9}$$

The variant with the greatest calculation time and the lowest storage requirement uses the LFSR method, which is applied "backwards", thus opposite to the (coding) LFSR method which has generated the monitoring numbers.

The number of the necessary passes d until the LFSR method reaches the initial state of the first coded page number $c_1$ is then counted. In the trivial case of the decoding of the first page number, the number of the passes d can thereby also be 0.

The sought, uncoded page number is then $$Z=d+1 \tag{10}$$

(since the first page is numbered with "1").

In a further solution that represents a compromise of calculation time and storage requirement, two tables are used. The first table is a listing of intermediate values that are evenly distributed across all coded page numbers. The second table contains the information as to whether a specific coded page number c is contained in the first table. The second table comprises N bits, thus one bit per possible value c.

As long as a page number c is not contained in the first table (the second table supplies information about this), the backwards-running LFSR method is applied to c. This is run through until a state c* is achieved that is contained in the first table. The number of the passes d is thereby counted as well. (In the trivial case, d=0 and c=c*). The achieved state c* is then sought within the first table. The sought page number z can be determined using the position of c* within the first table as well as the counted passes d. The interval of the intermediate values is v.

$$z=pos(c^*,\text{Table1})\cdot v+d \tag{11}$$

[pos(c*,Table1): position of c* in Table1]

Example:

Given n=m=16 and N=65536, every 64th value is stored as an intermediate value in the first table (v=64). The first table then comprises 1024 values or 2048 bytes. The second table requires 65536 bits or 8 kbytes. The number of the passes d always lies in the range from 0 to 63, and maximally 1024 search steps are needed within the first table.

For the case t>1 [and ggt(N,t)=1, see formula (7)], i.e. given a plurality of bits per monitoring number, a further calculation step must still occur.

Here the LFSR bit sequence (1 through N) is passed through multiple times given one passage of the page numbers (1 through Z). The page numbers are quasi-"mixed" into one another. The actual (uncoded) page number x is calculated as follows from the page number x acquired in the first decoding step.

$$x=((z-1)\bmod t)\cdot(N \text{ div } t+1)+((z-1)\text{div } t)+1 \tag{12}$$

Example:

$$t=2;n=16;m=8;Z=N=2^n-1=65535\rightarrow N \text{ div } t+1=32768$$

$$z=1\rightarrow x=0\cdot 32768+(0 \text{ div } 2)+1=1$$

$$z=2\rightarrow x=1\cdot 32768+(1 \text{ div } 2)+1=32769$$

$$z=3\rightarrow x=0\cdot 32768+(2 \text{ div } 2)+1=2$$

$$z=4\rightarrow x=1\cdot 32768+(3 \text{ div } 2)+1=32770$$

...

$$z=65533\rightarrow x=0\cdot 32768+(65532 \text{ div } 2)+1=32767$$

$$z=65534\rightarrow x=1\cdot 32768+(65533 \text{ div } 2)+1=65535$$

$$z=65535\rightarrow x=0\cdot 32768+(65534 \text{ div } 2)+1=32768$$

The page number in which an error has occurred can thus be determined with the method described above from the sequence of read monitoring numbers.

The LFSR method thus represents a preferred pseudo-random number generator since the sequence of monitoring numbers resulting from this is suitable for retroactive determination of the page numbers.

Instead of a pseudo-random number generator, other random number generators can also be used. For example, random number generators are known that use the thermal noise of a diode for generation of the random numbers. Corresponding hardware components are available in trade. If, however, no pseudo-random number generators are used, but rather generators for "real random number", the relevant sequence of the random numbers must be recorded in the printing system and made available to the monitoring devices.

In connection with the determination of the page number, an advanced analysis of the error is appropriate since the precise page number in which the error has occurred cannot always be specified. Rather, a page number can be specified in which the error has occurred at the earliest or, respectively, a page range in which the error has occurred. The preceding pages that respectively exhibit the same monitoring number must be traced back for the specification of this page range.

During the monitoring it is therefore appropriate that the monitoring numbers of at least n preceding pages are stored in order to be able to specify the earliest possible wrong page number in the event of an error. If the monitoring numbers of the preceding pages are not stored, in the event of an error all n preceding pages must always be discarded and reprinted in order to eliminate the wrong printout.

In an error case, two cases can be differentiated. For this, the currently-read monitoring number and the monitoring number of the previous page are compared:

a) If the current read monitoring number and the monitoring number of the previous page are not the same, it must be assumed that at least one page has not been printed. The range of the previous pages that respectively exhibit the same monitoring number can be output as an incorrect range.

b) If the current read monitoring number and the monitoring number of the previous page are the same, it must be assumed that at least one page has not been printed or that at least one page has been printed multiple times.

Example 1:

| Page nr.: | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 |
|---|---|---|---|---|---|---|---|---|---|---|---|---|---|---|---|---|---|---|---|---|---|---|---|---|---|---|---|
| Sequence A: | 0 | 1 | 0 | 1 | 1 | 0 | 0 | 0 | 0 | 0 | 0 | 0 | 1 | 1 | 1 | 0 | 1 | 0 | 0 | 1 | 1 | 1 | 1 | 0 | 0 | 1 | 1 |
| Sequence B: | 0 | 1 | 0 | 1 | 1 | 0 | 0 | 0 | 0 | 0 | 0 | 1 | 1 | 1 | 0 | 1 | 0 | 0 | 1 | 1 | 1 | 1 | 0 | 0 | 1 | 1 | 0 |

The sequence A is the reference sequence (=monitoring list) of monitoring numbers. The sequence B is the sequence of monitoring numbers read from the printed pages.

A deviation is established in the page nr. 27. The monitoring number of the previous page 26 ("0") deviates from the currently-read monitoring number of the page 27 ("1"). It is therefore examined further according to the case a).

The pages that exhibit the same monitoring number are now traced back, starting from the previous page 26. The page 26 has the monitoring number "0"; the preceding pages up to and including the page 21 likewise exhibit the monitoring number "0". An error can therefore at the earliest have occurred in the page 21 or the pages 21 through 27 can be specified as a range in which an error must have occurred.

It must be assumed that at least one of the pages from nr. 21 was not printed. The printing event must be aborted, the sheets from nr. 21 must be discarded, and the printing event must be repeated from sheet nr. 21.

Example 2:

| | | |

The data integrity monitoring in the printing systems shown in FIGS. 1 and 3 serves for logical control and monitoring of the printing event. Corresponding data integrity monitorings can also occur in other printing systems, for example in a printing system that comprises two printing groups in a common housing for simultaneous printing of the front side and the back side of a web-shaped or sheet-shaped recording medium, as it is known from U.S. Pat. No. 6,246,856.

Dash codes are printed as what are known as bit markings on every print page for data integrity control and monitoring of the printing event. The bit markings respectively contain one bit of information represented, for example, by a thin or thick dash. The controller determines whether a "0" or a "1" is printed as a bit marking using the LFSR algorithm already explained above that is run through for each print page.

The LFSR algorithm is based on an N-bit key and generates a unique bit sequence of the length $2^N$ bits. N successive bits within the bit sequence are respectively unique in turn and can therefore be understood as an "encrypted page number".

The controller also sends the internal state of the running LFSR algorithm (an N-bit value) to the device controller. A new value is transferred for every print page. The internal state is unambiguously determined for $2^N$ print pages, i.e. the state only repeats after $2^N$ cycles. 4096 different states result for N=12, whereby the repetition rate given a per-page association of the monitoring numbers (page numbers) is in this case 4096 pages. Every N-digit binary monitoring number is only present a single time in the monitoring list (or, respectively, in the LFSR algorithm), such that a unique association exists between all beginning and end positions of N-digit sections with their respective position numbers (page numbers). The same LFSR algorithm as in the controller runs in the control software of the device controller. In a first monitoring step, the device controller checks whether the state values supplied by the controller coincide with the values that have been calculated with its own LFSR algorithm. An advantage of these algorithms running in parallel can be immediately perceived. A deviation of the state values leads to the immediate abort of the printing event with an error message. This type of monitoring is, however, purely "virtual"; a checking of the print image has not yet occurred with this.

In a second monitoring step, the printed bit markings are scanned with marking sensors. The device controller evaluates the signals of the marking sensors and decodes the scan signals back into individual bits. The read bits must coincide with the bits supplied by the LFSR algorithm. Possible read errors of the marking sensors can or must also thereby be taken into account. It can occur that a bit marking is either not read at all or is falsely interpreted. It is thereby advantageous that individual read errors are tolerated within certain limits (for example N pages). A deviation of two or more bits within N pages leads to the abort of the printing event with an error message.

The "encrypted" page number can additionally be formed from N successive read bits, and from this, a "real", consecutive page number can in turn be decoded as described further above.

It is furthermore advantageous when the process of the data integrity monitoring can be tracked in the control panel (graphical user interface, GUI) 20, 20*a* or, respectively, 20*b* of the printing system. FIGS. 8 through 11 illustrate a representation in which the generated monitoring codes, the read monitoring codes as well as possible system messages are displayed that are generated based on the read result and/or the comparison of the sequence of the monitoring code and of the read monitoring codes. A display in table form is hereby provided that can be called up by the user (operator) at any time and that is continuously updated during a running printing event.

A row is provided in the table for every printed page. The first column in the table shows the process of the LFSR algorithm with the expected page number and the expected bit marking. A further column is displayed for every monitored printing group or for every monitored printer. These columns show for every page the page number decoded ("decrypted") from the bit markings, the individually read bit markings as well as the data integrity monitoring. N=12 applies for the examples of FIGS. 8 through 11. When a bit marking is not recognized, a warning message is output. When a bit marking with a wrong bit value is read, a warning message is likewise output, whereby the two cited error types are different from one another and entail different evaluation consequences. Namely, thresholds of how many errors of the first or second type may occur before the decision "data integrity error" is automatically made and the printing event is aborted can be adjusted for the evaluation. The error of the first type may thereby maximally occur twice per 12 pages before the printing event is aborted, while the error of the second type may only occur once per 12 pages before the printing event is aborted. When an error of the first type and an error of the second type occur inside of 12 pages, the printing event is still continued.

A maximum of 2 wrong or invalid marking values are accepted within 12 pages.

In the example of FIG. 8, in the 16 successive pages with the numbers 11 through 26, the bit markings of the page nr. 14 are not detected at the lower printing group and the bit markings of the page nr. 22 of the upper printing group are not detected. Only individualized bit markings are thus not detected by the marking sensor because there is a maximum of one incorrect reading on each printing group within 12 pages. The missing bit marking can then be replaced by the expected bit marking of the algorithm so that the page numbers are furthermore correctly decided and indicated. The individual read errors are tolerated. The undetected markings ("marking is missing") is marked with a first color, for example with yellow, in the color representation on the control panel.

In FIG. 9, bit markings on pages 14, 18 and 24 are not detected on the pages 11 through 26 on the lower printing group, i.e. the bit markings are very frequently not detected. This leads to an abort of the printing event with an error message. The page that has caused the error is marked with a second color, for example red, in the color control panel display.

The example shown in FIG. 10 shows the process given a single wrongly-interpreted bit marking. On page 15 a "0" is read instead of a "1". The decoding of the page numbers for the upper printing group is thereby temporarily disturbed. Due to the incorrectly-read bit, the subsequent page numbers are also incorrectly decoded since each page number is comprised of N=12 bits. The monitoring waits and sees whether a new bit error has occurred. If the error has regenerated only after 12 pages, the page numbers as of page 27 agree again. The incorrectly-read page and the subsequent 11 page numbers are marked yellow again in the color display.

The example shown in FIG. 11 shows the process given two or more incorrectly-read bit markings. The monitoring announces the abort of the printing event as of the second bit error on page nr. 25. However, the printing of N=12 pages (or negligibly more pages) does not occur until the decoding of the page numbers is "clear" again. Since at least as many pages as the N-digit binary number (with which the page numbers are coded) has bits (N=12) are printed after the occurrence of the second error, one can detect that a page has been jumped over in the upper printing group because, after the 12th page, the correct page number can be decoded again (assuming that a third error does not appear within 12 pages after the second error). With regard to the page nr. 32, the bit sequence registers the data source (first column), beginning with page 21 and ending with page 32: 111110111011. The lower printing group (right column) has all data correctly printed and therefore the same bit sequence of the printed bit markings between the pages 21 and 32. In contrast to this, the bit markings correctly printed by the upper printing group end at page 19. A serious bit error occurs at page 20: a 1 is read although a zero would have been expected. If one then follows the read bit values further until the page number 32 is decided, it emerges that the aforementioned bit pattern 111110111011 for the page number 32 has already occurred at a point at which the first bit originates from the (calculated) page number 20 (at which the first error occurred). From this it can clearly be concluded that a page was lost in the printed page sequence. This is immediately recognizable for the viewer in the displayed list according to FIG. 11 because, in the middle column for the upper printing group, the page numbers as of page 31 are shifted upwards by one row relative to the corresponding page numbers of the left column of the data source.

The preferred embodiment is described above using examples that print a web-shaped recording medium, in particular a paper web, on one side or both sides. However, it can also be used in order to synchronize differently colored printouts with one another or in order to check the data integrity of printouts on individual sheets, in particular when various data are printed on a common single sheet by different printing groups. The data integrity [sic] on a recording medium can occur via comparison of the monitoring codes between data source and data receiver (as in particular described in FIG. 8) or also via comparison between the monitoring codes of two data receivers, in particular when both data receivers are printing groups or various regions (front/back side) of a recording medium that have been printed with various printing groups or in separate printing processes. For this, the monitoring codes of the print data of both regions must have been generated with the same number sequence or a number sequence transformation must be implemented. A plurality of print images can be printed on each sheet on the front and back side and/or in different colors. In full color printing, for example, up to five (or more) individual ink colors are printed per sheet page.

A separate monitoring number can be generated for each print image and printed in the form of a monitoring marking. The monitoring marking of various print images should not overlap. The monitoring numbers of the individual print images must not be the same; rather, they can be varied according to a fixed scheme (for example the monitoring numbers of the back side can be inverted relative to those of the front side).

In a simple monitoring stage, only the monitoring numbers of the individual print images are read and compared among one another. It can be established whether the individual print images belong together, i.e. whether (for example) front side and back side fit together. However, it cannot be established whether a specific sheet to be printed is missing in the entire printout or has possibly been printed multiple times.

In a further monitoring stage, the read monitoring numbers are compared with a reference sequence of monitoring numbers that are supplied by an electronic circuit, from a stored table, by a calculation method or by a random number generator. A missing sheet or a sheet printed multiple times is detected with this. For this, it is appropriate that at least one monitoring number is provided on every sheet to be printed. However, in principle it is also possible to provide only every x-th sheet with a monitoring number, whereby here, however, the "resolution" of the monitoring method is reduced.

Examples for incorrect printouts that can be established by means of the method preferred embodiment are:

- a portion of the printout is missing,
- the printout is not correctly positioned on the page,
- the finished back side has been printed on a front side,
- color "layers" are exchanged with one another in a color printing, for example yellow with cyan, or
- inadequate register precision, i.e. front and back side are shifted relative to one another or the individual colors of a multi-page printout are shifted relative to one another.

One aspect of the preferred embodiment can be briefly summarized according to the following:

The preferred embodiment concerns a method for monitoring of pre-printed data in a printing system. Monitoring numbers that are contained in a monitoring list are inventively printed as a monitoring code. However, the monitoring numbers are not sorted in numeric succession in the monitoring list, but rather are arranged in an arbitrary order with an optimally high entropy. A printout is checked as to whether the monitoring numbers have been printed in the same order as in the monitoring list. It is hereby possible to use monitoring numbers with few digits, in particular even one-digit binary numbers.

The monitoring numbers can either be provided by stored monitoring lists or the monitoring lists can be generated by means of a corresponding method. A preferred method is the LFSR method since with this monitoring numbers are generated that are suitable, that is the page numbers are calculated from the monitoring numbers.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

I claim as my invention:

1. A method for monitoring printed data in a printing system, comprising the steps of:

generating only one monitoring code for each respective page of a plurality of pages of a recording medium to be printed, said monitoring code consisting of only one monitoring number;

also providing said monitoring numbers in a monitoring list but not in numeric succession, the monitoring numbers being repeatedly contained in the monitoring list so that a number of digits contained in the monitoring number is no more than three digits resulting in a reduction in size of the monitoring number on the respective page;

printing only the one monitoring code on the respective page;

monitoring the respective pages by comparing a sequence of the printed respective monitoring code monitoring numbers to a sequence of the monitoring numbers contained in said monitoring list and wherein a deviation in the compared sequences being used to identify an error for a page of the respective pages;

if the error is identified for the page, identifying a maximum number of pages of said respective pages to be discarded based on monitoring numbers of preceding pages to the page of said respective pages included in at least one of said sequence of the printed respective monitoring code monitoring numbers and said sequence of the monitoring numbers contained in said monitoring list;

the monitoring list being provided by a predetermined calculation method;

the calculation method for calculation of the numbers of the monitoring list comprises a pseudo-random number generator; and the pseudo-random number generator comprising a linear feedback shift register which generates a number sequence such that every arbitrary sequence of n successive numbers only occurs once within an overall sequence of N numbers, and an overall length of the overall sequence of the N numbers is maximized to $2^n$.

2. The method of claim 1, wherein identifying the maximum number of pages of said respective pages to be discarded further comprises:

determining a change in the monitoring numbers of said preceding pages included in at least one of said sequence of the printed respective monitoring code monitoring numbers and said sequence of the monitoring numbers contained in said monitoring list.

3. The method of claim 2, wherein a preceding page of said preceding pages is identified based on said determined change, said maximum number of pages of said respective pages to be discarded being identified based on said identified preceding page and said page of said respective pages.

4. A method for monitoring printed data in a printing system, comprising the steps of:

generating only one monitoring code for each respective page of a plurality of pages of a recording medium to be printed, said monitoring code consisting of only one monitoring number;

also providing said monitoring numbers in a monitoring list but not in numeric succession, the monitoring numbers being repeatedly contained in the monitoring list so that a number of digits contained in the monitoring number is no more than three digits resulting in a reduction in size of the monitoring number on the respective page;

printing only the one monitoring code on the respective page;

monitoring the respective pages by comparing a sequence of the printed respective monitoring code monitoring numbers to a sequence of the monitoring numbers contained in said monitoring list and wherein a deviation in the compared sequences being used to identify an error for a page of the respective pages;

if the error is identified for the page, identifying a maximum number of pages of said respective pages to be discarded based on monitoring numbers of preceding pages to the page of said respective pages included in at least one of said sequence of the printed respective monitoring code monitoring numbers and said sequence of the monitoring numbers contained in said monitoring list;

the list comprises N numbers, an arbitrary sequence of n numbers being always present only once in the list; and wherein a linear feedback shift register generates a number sequence such that said arbitrary sequence of said n numbers only occurs once within an overall sequence of the N numbers, and an overall length of the overall sequence of the N numbers is maximized to $2^n$.

5. A method for monitoring printed data in a printing system, comprising the steps of:

generating only one monitoring code for each respective page of a plurality of pages of a recording medium to be printed, said monitoring code consisting of only one monitoring number;

also providing said monitoring numbers in a monitoring list but not in numeric succession, the monitoring numbers being repeatedly contained in the monitoring list so that a number of digits contained in the monitoring number is no more than three digits resulting in a reduction in size of the monitoring number on the respective page;

printing only the one monitoring code on the respective page;

monitoring the respective pages by comparing a sequence of the printed respective monitoring code monitoring numbers to a sequence of the monitoring numbers contained in said monitoring list and wherein a deviation in the compared sequences being used to identify an error for a page of the respective pages;

after an error has been established, a last complete sequence of n read monitoring successive numbers is determined based on monitoring numbers of preceding pages to the page of said respective pages included in at least one of said sequence of the printed respective monitoring code monitoring numbers and said sequence of the monitoring numbers contained in said monitoring list, wherein a page number preceding said page of the respective pages having the error is established using said last complete sequence to identify a maximum number of pages of said respective pages to be discarded; and wherein a linear feedback shift register generates a number sequence such that every arbitrary sequence of said n read monitoring successive numbers only occurs once within an overall sequence of N numbers, and an overall length of the overall sequence of the N numbers is maximized to $2^n$.

6. A method for monitoring printed data in a printing system, comprising the steps of:

generating only one monitoring code for each respective page of a plurality of pages of a recording medium to be printed, said monitoring code consisting of only one monitoring number;

also providing said monitoring numbers in a monitoring list but not in numeric succession, the monitoring numbers being repeatedly contained in the monitoring list so that a number of digits contained in the monitoring number is no more than three digits resulting in a reduction in size of the monitoring number on the respective page;

printing only the one monitoring code on the respective page;

monitoring the respective pages by comparing a sequence of the printed respective monitoring code monitoring numbers to a sequence of the monitoring numbers contained in said monitoring list and wherein a deviation in the compared sequences being used to identify an error for a page of the respective pages, wherein in evaluating read monitoring numbers of said printed respective monitoring code monitoring numbers, said read monitoring numbers are compared with an order of the monitoring numbers of the monitoring list, a deviation resulting from said evaluating being assessed as an error;

if the error is identified for the page of the respective pages, identifying a maximum number of pages of said respective pages to be discarded based on monitoring numbers of preceding pages to the page of said respective pages included in at least one of said sequence of the printed respective monitoring code monitoring numbers and said sequence of the monitoring numbers contained in said monitoring list;

wherein a linear feedback shift register generates a number sequence such that every arbitrary sequence of n successive numbers only occurs once within an overall sequence of N numbers, and an overall length of the overall sequence of the N numbers is maximized to 2n.

* * * * *